United States Patent [19]

Sugata et al.

[11] 4,345,112

[45] Aug. 17, 1982

[54] HIGH STRENGTH CABLE USABLE UNDERSEA

[75] Inventors: Shigeo Sugata, Yokohama; Shigeru Tachigami; Satoru Kikkawa, both of Ichihara; Haruo Umezu, Narashino; Masanori Ohkubo, Ichihara, all of Japan

[73] Assignees: Technical Research and Development Institute, Japan Defence Agency; The Furukawa Electric Co., Ltd., both of Tokyo, Japan

[21] Appl. No.: 198,951

[22] PCT Filed: Sep. 5, 1979

[86] PCT No.: PCT/JP79/00236

§ 371 Date: May 6, 1980

§ 102(e) Date: May 1, 1980

[87] PCT Pub. No.: WO80/00635

PCT Pub. Date: Apr. 3, 1980

[30] Foreign Application Priority Data

Sep. 6, 1978 [JP] Japan ..... 53/109401

[51] Int. Cl.[3] ..... H01B 7/18

[52] U.S. Cl. ..... 174/107; 174/109; 174/120 R; 57/212

[58] Field of Search ..... 174/107, 109, 120; 57/210, 211, 212, 218; 350/96.23; 428/380

[56] References Cited

U.S. PATENT DOCUMENTS

| | | | |
|---|---|---|---|
| 3,339,007 | 8/1967 | Blodgett | 174/109 X |
| 3,485,224 | 12/1969 | Ronald | 174/109 |
| 4,069,410 | 1/1978 | Kup, Jr. | 174/109 X |

*Primary Examiner*—Volodymyr Y. Mayewsky

*Attorney, Agent, or Firm*—Pearne, Gordon, Sessions, McCoy & Granger

[57] ABSTRACT

This invention relates to a high strength cable to electrically and mechanically connect a vessel or a base on the sea with submarine instruments. Such a cable is required to transfer a signal or electric power and to positively transfer to a tension member in the cable a drawing force which is applied to an outer sheath from a capstan when the cable is wound up or drawn out by the capstan. This invention has a feature in that layers 6A, 6B, 6C and 6D of lapping tape having a high friction coefficient such as rubber coated tape are provided between a tension member 7 and an outer sheath 8. This feature prevents a displacement between the tension member 7 and the outer sheath 8.

5 Claims, 3 Drawing Figures

HIGH STRENGTH CABLE USABLE UNDERSEA

TECHNICAL FIELD

This invention relates to a high strength cable usable undersea, and more particularly to a high strength cable used for electrically (or optically) and mechanically connecting a vessel or a base on the sea with submarine instruments such as various measuring devices or operating machines, for example.

BACKGROUND ART

Such a cable is required to have a high tensile strength and to be able to fully withstand its winding up and its drawing out by a capstan because it is towed by a vessel, wound up on the vessel or pulled in the sea.

Such a conventional cable comprises a cable core transferring a signal or electric power, a lapping tape and an inner sheath on the cable core, a tension member provided on the inner sheath, an interposing member provided on the tension member to control the specific gravity of the cable, and an outer sheath provided on the interposing member with another lapping tape disposed between the interposing member and the outer sheath.

Since the undersea high strength cable has a long length of more than 1,000 m, the cable is stressed by an extremely high tensile force when it is pulled in the sea or wound up. Therefore, the tension member is so designed to fully withstand such a high tensile force. When the cable is wound up on the vessel by a capstan, for example, the drawing force from the capstan is at first applied to the outer sheath, and then transferred to the tension member provided inside the outer sheath. However, in the prior art undersea high strength cable constructed in accordance with the above description, since the interposing member between the outer sheath and the tension member is provided to control the specific gravity, the integrity of the outer sheath with the tension member is incomplete. Thus, it will be found that a high tensile force applied to the outer sheath causes a slight elongation of the outer sheath. This causes a displacement between the outer sheath and the tension member. As such a displacement is accumulated in a longitudinal direction, a portion of the outer sheath is deformed in a bellows manner, and as a result, if the cable is used as it is, the outer sheath will tend to be broken.

DISCLOSURE OF INVENTION

This invention provides a high strength cable usable undersea and comprising an inner sheath provided outside a cable core for transmitting a communication signal or electric power, a tension member of a twisted layer and an outer sheath successively provided on the tension member, characterized in that a lapping tape having a high friction coefficient is provided between the tension member and the outer sheath.

With the invention, since there is provided the lapping tape having a high friction coefficient, displacement between the tension member and the outer sheath does not occur. Thus, the invention provides a high strength submarine cable having an excellent durability.

In the cable of the invention, in case that the tension member comprises a plurality of layers, lapping tape having a high friction coefficient may be preferably provided between the layers of the tension member. With the cable constructed as aforementioned, since no displacement occurs between the layers of the tension member, the tensile force applied to each of the layers is advantageously made uniform.

Furthermore, in the cable of the invention, a lapping tape having a high friction coefficient may be preferably provided between the tension member and the inner sheath. With the cable constructed as aforementioned, the integrity of the inner sheath with the tension member is complete, and as a result, the durability of the cable is improved.

The tension member may be composed of strings of bundled high strength fibers, fiber reinforced plastic rods, and the like.

In case that the tension member comprises the twisted layers of strings of bundled high strength fibers and that the lapping tape is provided on the tension member by tightly winding the tape having a high friction coefficient thereon, the twisted layers of the tension member are made thinner because the strings of the twisted layers are squeezed into flatness. Therefore, the outer diameter of the cable can be smaller and, also, the tensile force applied to the tension member can be made uniform because of high density of the tension member.

If the specific gravity of the cable is required to be larger, then a plurality of braided layers of thin metal wire may be effectively provided between the tension member and the outer sheath.

BEST MODE FOR CARRYING OUT THE INVENTION

Figure 1:
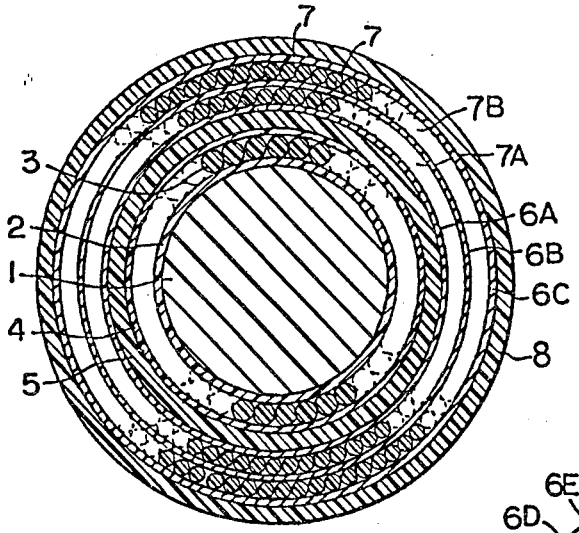
FIGS. 1 to 3 are cross sectional views of the embodiments of the cable constructed in accordance with the invention, respectively.

FIG. 1 shows one embodiment of the invention. In this figure, a reference numeral 1 designates a cable core having a plurality of core wires or strands gathered together for transferring an electric signal, optical signal or an electric power. The cable core is disposed at the center of the cable where least influence is had upon the cable core when the cable is subject to bending. A reference numeral 2 designates a lapping tape provided outside the cable core 1. The lapping tape may be composed of polyester tape or the like as in the conventional cable. A reference numeral 3 designates an interposing member provided outside the lapping tape 2 for decreasing the specific gravity of the cable. The interposing member may be composed of plastic pipe, foamed plastic rods or the like.

A reference numeral 4 designates a lapping tape provided outside the interposing member 3 to adjust the specific gravity. The lapping tape 4 may be composed of material similar to that of the lapping tape 2. A reference numeral 5 designates an inner sheath provided outside the lapping tape 4 for assuring a water-proofness of the cable core. The inner sheath 5 may be composed of material such as polyethylene, polyvinyl chloride or rubber, for example.

Outside the inner sheath 5 are successively provided a lapping tape 6A, a twisted layer 7A of a tension member 7, a lapping tape 6B, a twisted layer 7B of the tension member 7, a lapping tape 6C and an outer sheath 8. The tension member 7 may be composed of strings of bundled high strength fibers, fiber reinforced plastic rods, or the likes. In the illustrated embodiment, it is composed of fiber reinforced plastic rods. Lapping tapes 6A, 6B and 6C may be suitably composed of materials having a high friction coefficient such as rubber coated cloth or non-woven cloth, for example. The outer sheath 8 is provided for improving water proofness, weather proofness of the cable and frictional resistance to the tension member 7. It may be preferably formed by pressurized extrusion in order to improve its integrity with the tension member 7.

With the undersea high strength cable constructed as aforementioned, since the outer sheath and the tension member are disposed with the lapping tapes having a high friction coefficient provided between them, the tensile force applied to the outer sheath by a capstan or the like is positively transferred to the tension member, and as a result, there occurs no displacement between the outer sheath and the tension member. Also, since the lapping tape having a high friction coefficient is interposed between two layers of the tension member, there occurs no displacement between the inner and outer layers of the tension member. As a result, the tensile force applied to the tension member is made uniform. Furthermore, since the lapping tape having a high friction coefficient is interposed between the tension member and the inner sheath, there occurs no displacement between the tension member and the members within the inner sheath. Thus, the cable core can be fully prevented from being subjected to the tensile force.

Figure 2:
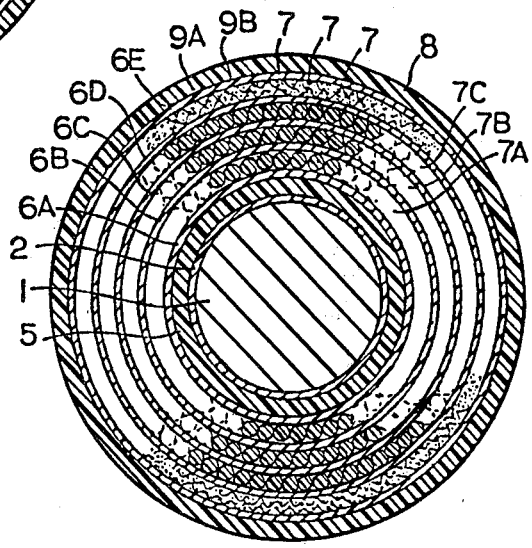

FIG. 2 shows another embodiment of the invention. In this figure, the same numerals as those of FIG. 1 designate the same components or equivalents.

The differences of this embodiment from that of FIG. 1 are that the interposing member 3 for adjusting the specific gravity and the lapping tape 4 are omitted, that another twisted layer 7C of the tension member is provided outside the lapping tape 6C, and that outside the layer 7C are successively provided a lapping tape 6D, braided layers 9A and 9B and a lapping tape 6E, on which lapping tape 6E the outer sheath 8 is provided. The lapping tapes 6D and 6E are composed of materials having a high friction coefficient.

The braided layers 9A and 9B of thin metal wire serve to increase the specific gravity of the cable. Since the braided layers are provided near the outer sheath 8, the circumference of the braided layers may be so large as to prevent the diameter of the cable from increasing.

Also, the lapping tapes 6D and 6E protrude into the braided layers 9A and 9B because of their fine unevenness. This results in a large friction of the braided layers with the lapping tapes 6D and 6E. Thus, with the construction of this embodiment, the tension member 7C inside the lapping tape 6D is prevented from being displaced from the outer sheath 8 outside the lapping tape 6E.

Figure 3:
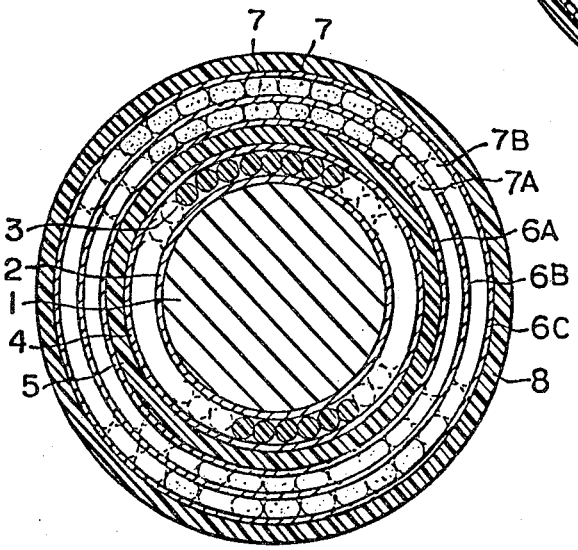

FIG. 3 shows an embodiment in which the tension member is composed of strings of bundled high strength fibers.

More particularly, each layer of the tension member 7 is composed of strings of bundled high strength fibers, and the lapping tapes 6B and 6C are provided outside the twisted layers 7A and 7B of such strings. This results in each layer of the tension member 7 being flattened because the lapping tapes 6B and 6C tighten the layers of the tension member, respectively. Thus, the twisted layers of the tension member 7 become thinner, which causes the diameter of the cable to be decreased. The high strength fibers may be suitably ones produced by Du Pont, U.S.A. and commercially available under Kevlar (trademark). Since the other structures are substantially identical to those of FIG. 2, the detail description will be omitted with the same components as those of FIG. 2 having the same numerals attached.

Although, in the above embodiments, the tension member has two or three layers, the number of the twisted layers may be properly determined by the required tensile strength and diameter of the cable.

We claim:

1. A high strength cable usable undersea and comprising an inner sheath provided outside a cable core for transmitting a communication signal or electric power and a tension member of a twisted layer and an outer sheath successively provided outside said inner sheath, characterized in that said tension member comprises a plurality of twisted layers, a lapping tape having a high friction coefficient is provided between said tension member and said outer sheath, and a lapping tape having a high friction coefficient is interposed between the adjacent twisted layers.

2. A high strength cable usable undersea as set forth in claim 1, wherein a lapping tape having a high friction coefficient is interposed between the twisted layer of said tension member and said inner sheath.

3. A high strength cable usable undersea as set forth in any of claims 1 or 2 wherein said tension member is composed of strings of bundled high strength fibers which are flattened by being squeezed by the lapping tape provided on said strings.

4. A high strength cable usable undersea as set forth in any of claims 1 or 2, wherein said tension member is composed of fiber reinforced plastic rods.

5. A high strength cable usable undersea as set forth in any of claims 1 or 2, wherein a plurality of lapping tapes are provided between said tension member and said outer sheath, and a braided layer of thin metal wire being interposed between the adjacent lapping tapes.

* * * * *